US005557372A

United States Patent [19]

Ojima et al.

[11] Patent Number: 5,557,372

[45] Date of Patent: Sep. 17, 1996

[54] CONTACT CHARGER AND IMAGE FORMING APPARATUS PROVIDED WITH SAME

[75] Inventors: Seishi Ojima, Takatsuki; Isao Doi, Toyonaka; Izumi Osawa, Ikeda, all of Japan

[73] Assignee: Minolta Co., Ltd., Osaka, Japan

[21] Appl. No.: 329,092

[22] Filed: Oct. 25, 1994

[30] Foreign Application Priority Data

Oct. 27, 1993 [JP] Japan ..... 5-269225

[51] Int. Cl.[6] ..... G03G 15/02

[52] U.S. Cl. ..... 355/219; 361/225

[58] Field of Search ..... 355/219, 210, 355/222, 227, 200; 361/221, 225, 230, 235

[56] References Cited

U.S. PATENT DOCUMENTS 4,380,384 4/1983 Ueno et al. .

5,148,219 9/1992 Kohyama ..... 355/219

5,192,974 3/1993 Ikegawa et al. .

5,196,892 3/1993 Mitsuaki ..... 355/269

5,278,614 1/1994 Ikegawa et al. ..... 355/219

5,398,102 3/1995 Wada et al. ..... 355/219

*Primary Examiner*—Thu Anh Dang

*Attorney, Agent, or Firm*—Burns, Doane, Swecker & Mathis, L.L.P.

[57] ABSTRACT

A contact charging device having a charging member including a rotatable support member and a plurality of flexible films. One end of each the films is attached to the support member, and a free end of each the films is in contact with surface of the charge-receiving member for charging the surface of a charge-receiving member.

21 Claims, 5 Drawing Sheets

FIG. 3
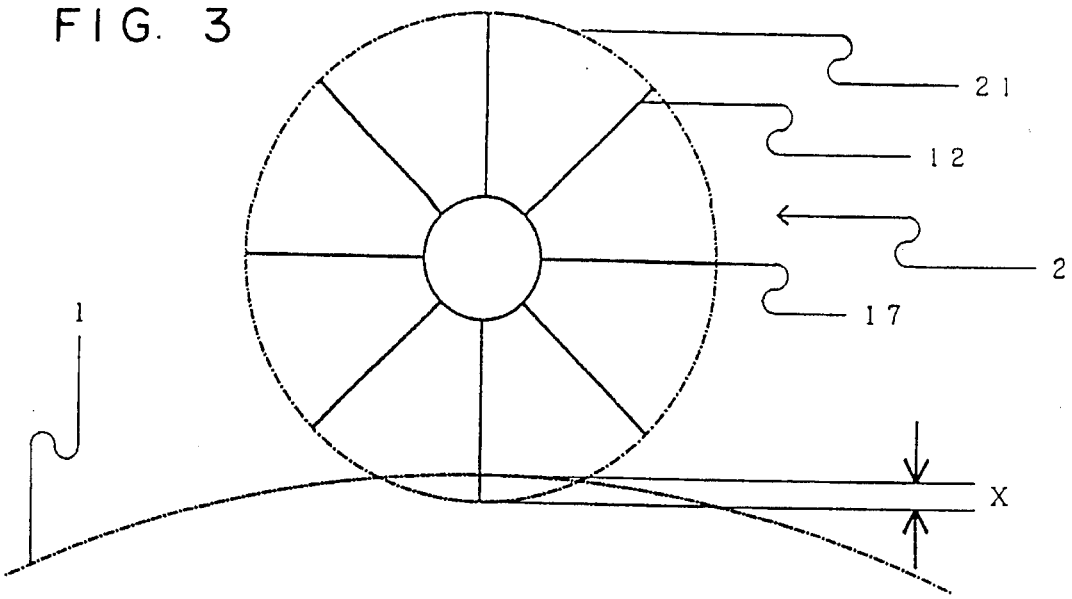
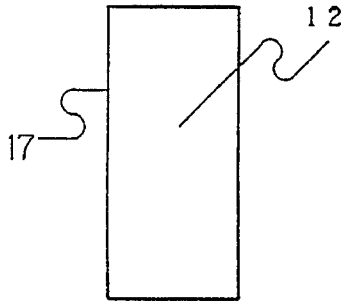
FIG. 4(a)
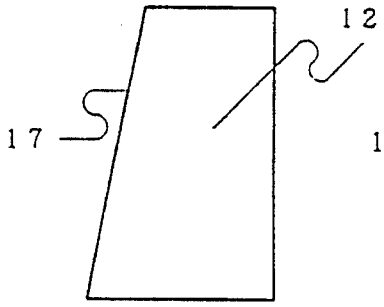
FIG. 4(b)
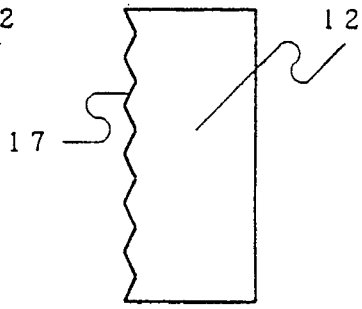
FIG. 4(c)
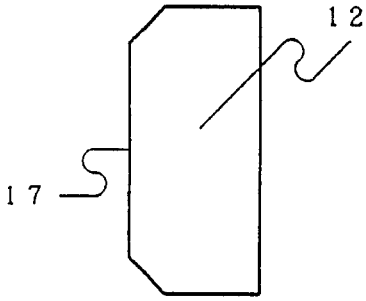
FIG. 4(d)
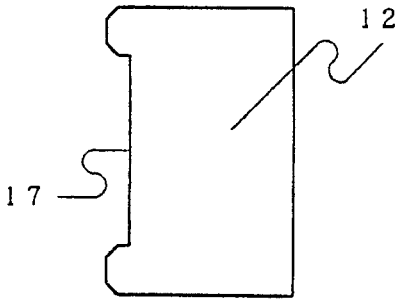
FIG. 4(e)

CONTACT CHARGER AND IMAGE FORMING APPARATUS PROVIDED WITH SAME

BACKGROUND OF THE INVENTION

1. Field of the Invention

The present invention relates to a contact charger and image forming apparatus provided with same, such as electrophotographic copying machines, printers, facsimile and the like.

2. Description of the Related Art

In image forming apparatus such as electrophotographic copiers, printers, facsimiles and the like, the surface of an electrostatic latent image carrying member such as a photosensitive drum or the like is charged by means of a charging device. The charged region of said surface is subjected to image light exposure to form an electrostatic latent image thereon, said latent image is subsequently developed so as to be rendered visible, transferred onto a transfer medium, and fixed on said transfer medium.

Various types of such charging devices are known. Examples of such charging devices include corona chargers which utilize a corona discharge via a corotron system, scorotron system, serrated electrode array system or the like, and contact chargers wherein a charging member such as a roller, brush, film, belt or the like is brought into contact with the surface of the electrostatic latent image carrying member.

Chargers that utilize a corona discharge are advantageous insofar as they provide stabilized charging, however they also have certain disadvantages in that they produce large amounts of ozone, which leads to deterioration of the electrostatic latent image carrying member, and adversely affects humans. Thus, attention has become focused on contact chargers which produce markedly less ozone compared to corona chargers. Among the aforesaid charger types, contact chargers having a film configuration are an inexpensive charging method wherein excellent contact is readily maintainable with an electrostatic latent image carrying member.

The aforesaid contact charger of a film type provides a processing speed (peripheral speed of the electrostatic latent image carrying member) in the low range. Image forming apparatus having the processing speed in the high speed range are desirable to reduce the amount of generated ozone, however, film-type contact chargers suitable for image forming apparatus having processing speeds of 22 cm/sec or greater are not available. In other words, film-type contact chargers having a high degree of durability are not available.

In conventional film-type contact chargers, soiling of the electrostatic latent image formed on the film surface after a few image formations, e.g., soiling via adhesion of toner, paper debris and the like, produces streak-like image noise.

U.S. patent application Ser. No. 5,192,974, for example, discloses a film-type contact charger wherein the film is supported by a lateral support member, but this device does not eliminate the disadvantage of marked soiling of a stationary film. U.S. patent application Ser. No. 4,380,384 discloses a contact charger of a belt-type wherein said belt has a movable surface, but this device does not eliminate the aforesaid disadvantage because when toner once adheres to a portion of the aforesaid continuous belt, the resulting soiling of the belt surface rapidly produces a broad streak.

SUMMARY OF THE INVENTION

A main object of the present invention is to provide a contact charger having a high degree of durability.

Another object of the present invention is to provide a contact charger capable of producing excellent images even when used in high speed image forming apparatus.

These and other objects of the invention are achieved by providing a contact charger for charging the surface of a charge-receiving member by bringing a charging member in contact with said charge-receiving member, said charging member comprising:

a rotatable support member;

a plurality of flexible films, one end of each the films attached to said support member, and a free end of each the films being in contact with a charge-receiving member thereby charging the surface of said charge-receiving member.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 3 illustrates the positional relationship of the charging device of FIG. 2 relative to a photosensitive drum;

FIG. 4 is an illustration showing configurations of the film material of the charging device of the invention;

DETAILED DESCRIPTION OF THE PREFERRED EMBODIMENTS

Figure 1:
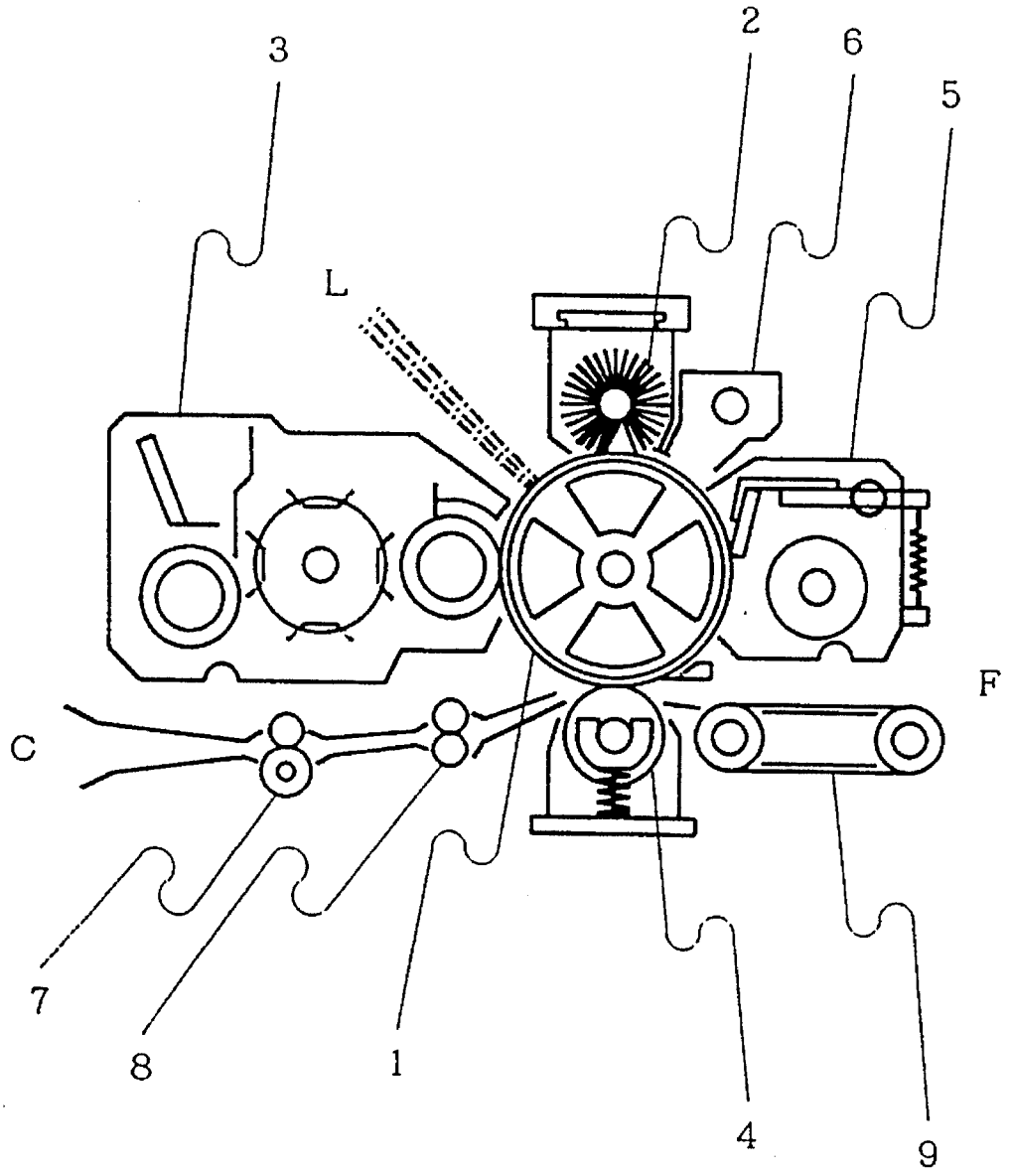
FIG. 1 briefly shows the construction of the essential portions of a copying machine incorporating the charging device of the present invention.

The embodiments of the invention described hereinafter are invariably incorporated in the copying machine, the essential portions of which are shown in FIG. 1. First, the copying machine shown in FIG. 1 is described below.

A photosensitive drum 1, i.e., an electrostatic latent image carrying member, is provided centrally in the copying apparatus of FIG. 1. This drum is rotatably driven in a counterclockwise direction in the drawing by a drive means which is not illustrated. Arranged sequentially around the periphery of the aforesaid photosensitive drum 1 are charger 2,developing device 3, transfer drum (roller) 4, cleaning device 5, and eraser 6. Charger 2 is a charging device of the present invention, and is provided with a plurality of films which make contact with photosensitive drum 1 and are rotatable via a support means and drive means not shown in the illustration.

An optical unit (not shown in the drawing) is provided above photosensitive drum 1. This optical unit typically comprises an exposure lamp, reflective mirrors, optical lenses, slit and the like. Image exposure light is emitted from the aforesaid optical unit onto the surface of photosensitive drum 1 from position L indicated in the drawing.

Arranged sequentially to the left side of photosensitive drum 1 in the drawing are a pair of intermediate rollers 7, and pair of timing rollers 8. Transfer sheets accommodated in a paper cassette not shown in the drawing are supplied from position C in FIG. 1.

In this copying machine, the surface of photosensitive drum 1 is uniformly charged to a predetermined potential by charger 2, and said charged surface is subjected to image exposure light emitted from the optical unit at position L so as to form an electrostatic latent image on said surface. The thus formed electrostatic latent image is developed by developing device 3 so as to form a toner image which is moved to a transfer region confronting transfer drum 4.

A copy sheet fed from position C passes through the pair of intermediate rollers 7 and arrives at the pair of timing rollers 8, and is subsequently transported to the transfer region synchronously with the toner image formed on the surface of photosensitive drum 1. At the transfer region, the toner image on the surface of photosensitive drum 1 is transferred onto the copy sheet by the action of transfer drum 4. After the toner image is fixed to the transfer sheet by a fixing device not shown in the drawing, the transfer sheet is discharged in the direction of position F.

After the toner image has been transferred onto the transfer sheet, the residual toner remaining on the surface of photosensitive drum 1 is removed therefrom by cleaning device 5, and the residual charge remaining on the surface of photosensitive drum 1 is discharged by eraser 6.

The processing speed (peripheral speed of photosensitive drum 1) of the previously described copying machine is variable within the range of 10~40 cm/second. Developing device 3 is a standard two-component developing device.

The aforesaid photosensitive drum 1 is an organic photosensitive member of a function-separated type provided with sequential laminations comprising a charge-generating layer superimposed over a conductive substrate, and a charge-transporting layer superimposed over said charge-generating layer.

Although the photosensitive member used in the present embodiment of the invention is the previously mentioned function-separated organic photosensitive member, it is to be understood that the invention is not limited to a photosensitive member of this type.

With regard to the range of sensitivity of the photosensitive member, the photosensitive member used desirably has a sensitivity in the long wavelength range in image forming systems using long wavelength light of a semiconductor laser (780 nm) optical system, LED array (680 nm) optical system or the like. For example, photosensitive members having sensitivity in the visible light range may be used in image forming systems using visible light as a light source such as liquid crystal shutter arrays, PLZT shutter array and the like, image forming systems using visible light laser as a light source, image forming system using a fluorescent light array as a light source, or analog image forming systems typical of copying apparatus which use visible light and lenses and mirrors in their optical system.

Although the previously mentioned photosensitive member may be constructed as a function-separated organic photosensitive member provided with a separate charge transporting layer superimposed over a charge generating layer, said photosensitive member may also be a photosensitive member of the so-called inverted layer type having the charge generating layer superimposed over the charge transporting layer, or may be a photosensitive member having a so-called monolayer construction wherein the charge generating function and charge transporting function are combined. Furthermore, the charge generating materials, charge transporting materials, bonding agents, additives and the like may be suitably selected from among well known materials according to purpose. Photosensitive materials are not limited to organic materials, inasmuch as various nonorganic materials may be used, e.g., zinc oxide, cadmium sulfide, selenium alloy, amorphous silicon alloy, amorphous germanium alloy and the like.

Photosensitive members suitable for the present invention may be provided with a surface overcoat layer to improve durability and resistance to environmental conditions, and may further be provided with an undercoat layer to improve charging characteristics, image quality, and bonding characteristics. Materials useful for the aforesaid overcoat layer or overcoat layer include, for example, resins such as ultraviolet-curing resins, cold-setting resins, thermoset resins and the like, and resins mixtures having resistance regulating material(s) dispersed in the aforesaid resins, thin-layer vacuum deposition materials such as metallic oxides, metallic sulfides and the like used to form a thin film in a vacuum by a vacuum deposition method, ion plating method or the like, and unshaped carbon film, unshaped silicon carbide film or the like manufactured using a plasma polymerization method.

The substrate materials for the photosensitive member applicable to the present invention are not specifically limited to substrates having an electrically conductive surface, and may be of a shape other than cylindrical such as plate-shaped or belt-shaped. The surface of the substrate may be subjected to treatment by roughening process, oxidation process, coloring process and the like.

The toner used in the previously mentioned developing device 3 is an unshaped styrene-acrylic toner of a positive-charge type.

The aforesaid toner is mixed with carrier particles and loaded into the previously mentioned developing device 3 for use as a developer.

Although the developer used in the present embodiment of the invention comprises a positive-charge type, unshaped black toner and carrier, it is to be understood that developers applicable to the embodiments of the invention are not limited to this type of developer. Negative-charge toners, translucent toners, magnetic toners, iron powder carriers, binder type carriers, resin-coated carriers, monocomponent developing methods, reversal developing methods and the like may be used as appropriate in accordance with the polarity of the photosensitive member and image forming process being used.

Toner color is not limited to black, and yellow, magenta, and cyan color toners may be selected as suitable. Usable toner is not limited to unshaped toners, insofar as toners of defined shaped may also be used, e.g., spherical toners, crystal form toners and the like. Usable carriers are not limited to powders insofar as the selected carrier possesses the characteristics required for the developing systems such as conductive brushes, conductive rollers and the like.

Furthermore, the developer used may incorporate lubricants such as, for example, bis or powders such as vinylidene polyfluoride resin, teflon resin, PMMA resin or the like to improve flow characteristics and cleaning properties.

Figure 2:
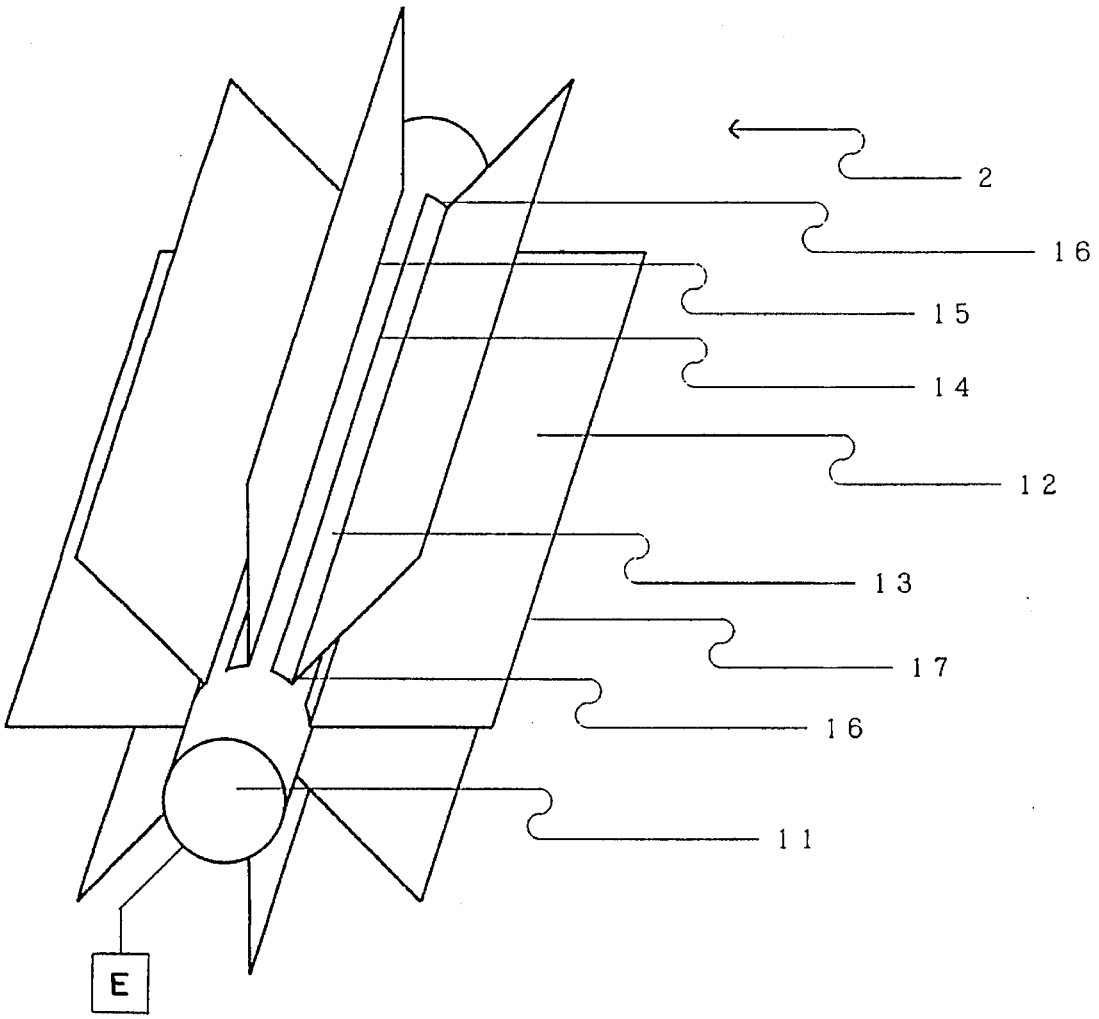
FIG. 2 is a perspective view showing the basic construction of a first embodiment of the charging device of the invention.

The basic construction of a first embodiment of charger 2 in the previously described copying machine is described hereinafter with reference to FIG. 2. FIG. 2 is a transverse section view of charger 2. Charger 2 has a construction comprising conductive substrate 11 over the surface of which are disposed eight film members 12 equally spaced on the surface of the substrate 11.

The conductive substrate may be rotatable by a drive source such as a motor or the like (not shown in the drawing), or may be driven by the drive source of photosensitive drum 1 (also not shown in the drawing ).

Useful materials as the conductive substrate include metallic materials such as iron, SUS, aluminum, copper, chrome, titanium and the like, or resin materials and fiber materials which have been subjected to treatment so as to be rendered electrically conductive.

Examples of useful materials for the film members of the contact charger are plastic film materials such as polyethylene, polypropylene, ionomer, polyvinyl alcohol, polyvinyl acetate, ethylene-vinyl acetate copolymer, poly-4-methyl-pentene- 1, polymethyl methacrylate, polycarbonate, polystyrene, acrylonitrile-methyl acrylate copolymer, acrylionitrile-butadiene-styrene copolymer, polyethylene terephthalate, polyurethane elastomer, cellulose nitrate, cellulose acetate, cellulose triacetate, cellulose propionate, cellulose acetate butyrate, ethyl cellulose, regenerated cellulose, nylon 6, nylon 66, nylon 11, nylon 12, polyamide, polysulfon, polyether sulfon, polyvinyl chloride, vinyl chloride-vinyl acetate copolymer, polyvinylidene chloride, vinylidene chloride-vinyl chloride copolymer, vinyl-nitrile rubber metal, polytetrafluoroethylene, polychlorotrifluoroethylene, polyvinyl fluoride, polyvinylidene fluoride, polyethylenetetrafluoroethylene copolymer and like plastic film materials in which are dispersed powder-like or fiber-like conductive carbon, iron, aluminum, copper, chrome, titanium, tin, zinc, gold, silver, cobalt, lead, platinum and like metals, metallic oxides such as antimony oxide, indium oxide, molybdenum oxide, and conductive polymers such as polyacetylene, polypyrole, polythiophene and the like.

The film members may comprise two or more types of materials, and may have two or more layers. Films of this type may be formed using an casting method, extrusion method, stretching method, or typical film forming method.

Electrical resistivity of the film members in the aforesaid film-type contact charger is preferably not more than $10^8$ Ωcm to prevent voltage drops, and is preferably $10^3$ Ωcm or greater to prevent spot discharge generation due to excess current. Although the thickness of the film members is not specifically limited insofar as said thickness is sufficient to assure bonding with the electrostatic latent image carrying member and film strength is sufficient to present no disadvantage relative to film handling and durability, in general, a thickness of about 5~500 μm is desirable.

In the previously described film-type contact charger, as shown in FIG. 2, each of film members 12 adheres to the surface of conductive support member 11 via an adhesive coating on an edge 13 left for applying said adhesive. The peripheral portions 14, 15, 16 of edge 13 are coated with an electrically conductive paste, so as to electrically connect conductive support member 11 and each of the film members 12.

Examples of useful electrically conductive paste include silver paste (product names: NP4908, NP4909, NP4910 manufactured by Noritake Co.; or product name: Dotite S-1 manufactured by Fujikura Kasei Co., Ltd.), silver palladium paste (product name: NP3410, manufactured by Noritake Co.), silicone binder-carbon paste (product name: KE3942, manufactured by Shin-Etsu Chemical Co., or product name: KE4576, manufactured by Noritake Co.), copper paste (product name: NP-9300, manufactured by Noritake Co.), gold paste (product names: NP5256, NP5258, manufactured by Noritake Co.), aluminum paste (product name: NP9203, manufactured by Noritake Co.), nickel paste (product name: NP9284, manufactured by Noritake Co.), platinum paste (product name: NP1000, manufactured by Noritake Co.) and the like.

Although the configuration of the free end of each the film members 12 of the first embodiment is rectangular, as shown in FIG. 4*a*, it is to be understood that the present invention is not specifically limited to such a configuration. Due to requirements such as matching processes of electrostatic latent image carrying member, developer and the like, restrictions of configuration relative to installation, film forming, film cutting, ease of positioning and alignment for processing, preventing bending which is an inherent characteristics of films and like requirements, an oblique cut configuration of the free end of each the film members may be used such as that shown in FIG. 4*b*, a jigsaw cut configuration of the free end of each the film members 12 may be used such as that shown in FIG. 4*c*, or configurations having specific convexities or concavities in the free end of each the film members may be used such as those shown in FIGS. 4*d* and 4*e*, respectively.

The plurality of individually mounted film members need not have identical configurations nor incorporate identical materials inasmuch as a plurality of types of film members may be used having different configurations, resistance values, bending characteristics, and materials. Although the first embodiment utilizes a plurality of film members having equally spaced dispositions, it is to be understood that unequal spacings may also be used. An odd number of film members and an even number of film members of different types may be used. Individual film members are not limited to singular film constructions. For example, a monolayer film may have a specific resistance value distribution with an irregular film thickness, or the distribution of a conductive agent within the film material may vary within a monolayer construction to achieve a specific resistance distribution. Alternatively, a single film may be formed of a plurality of thin lamination layers, or a single film may be formed by having a specific thin layer adhered to a part or parts of a single film.

Figure 5:
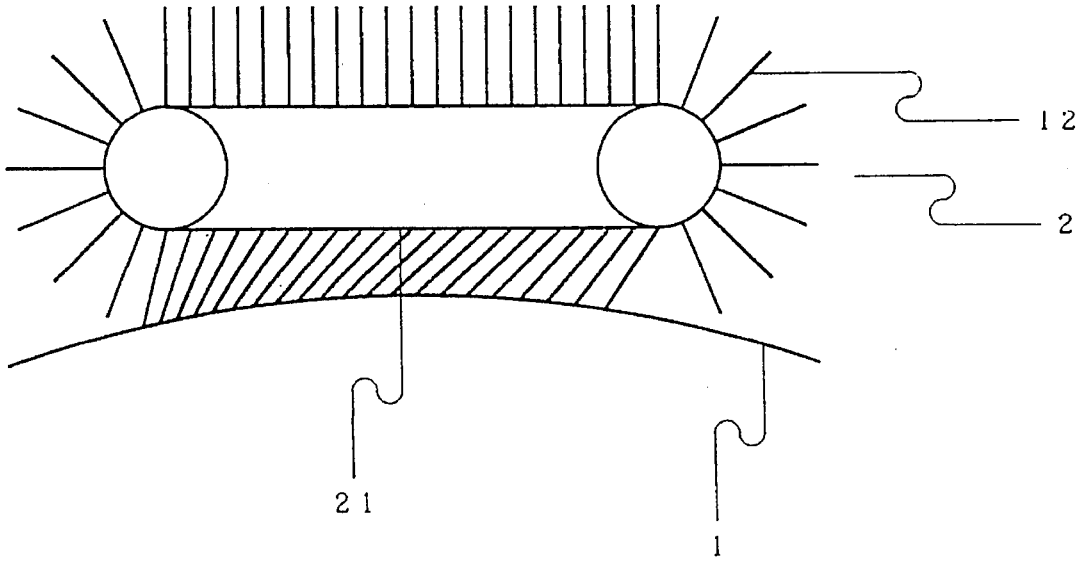
FIG. 5 shows the construction of a second embodiment of the charging device of the invention.
Figure 6:
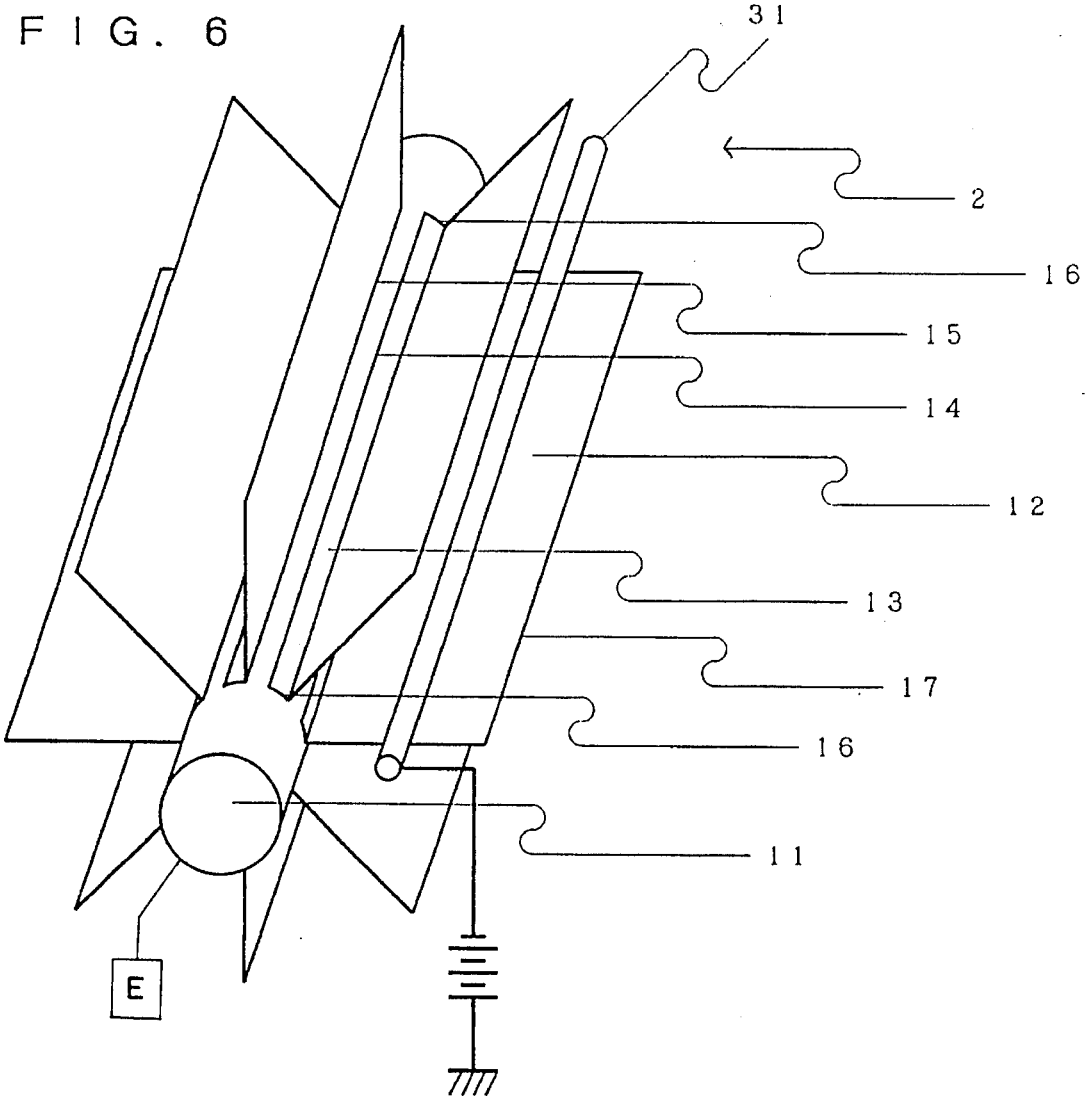
FIG. 6 is a perspective view showing the construction of a third embodiment of the charging device of the invention.

Conductive support member 11 need not be rod-shaped, and may be, for example, a belt-like member such as that of conductive support member 21 of a second embodiment shown in FIG. 5 insofar as the objects of the present invention are achieved thereby. Furthermore, the objects of the present invention are sufficiently achieved by providing a flicker bar to which a voltage is applied, or a bias electrode or the like as a means 31 for removing debris adhered to the film members 12. The removing means 31 is provided adjacently to the film member 12 out of contact with the photosensitive drum in the third embodiment as shown in FIG. 6. A voltage in the range of ±1,000 V, and preferably in the range of ±500 V, is applied to the aforesaid flicker bar relative to a direct current (DC) portion of a voltage applied to conductive support member 11.

The charging device of the present invention is described hereinafter in terms of experiments conducted with said charging device installed in a copying machine having the essential construction shown in FIG. 1.

Photosensitive drum 1 in the aforesaid copying machine is an negative-charge, organic photosensitive member of a function-separated type having excellent sensitivity relative to the range of spectral luminous efficiency. The method of manufacturing photosensitive drum 1 is described hereinafter.

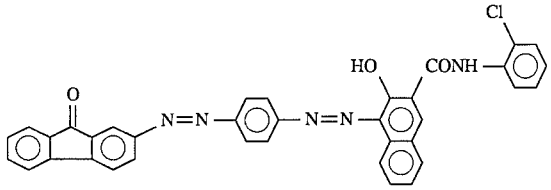

Loaded into a sand grinder were 0.45 parts-by-weight (pbw) azo compound having the chemical structure shown in the equation above, 0.45 pbw polyester resin (Bairon 200; Toyobo Co., Ltd.), and 50 pbw cyclohexanone, which was dispersed for a 24 hour period to obtain a photosensitive application fluid. At this time, the photosensitive application fluid had a viscosity of 20 cp at 20° C.

The application fluid was applied by a dipping method to the surface of a cylindrical aluminum substrate the surface of which was pretreated by a "bite" machining process so as to form, after drying, a charge generating layer having a thickness of 0.3 μm. The cylindrical substrate was an aluminum alloy having 0.7 percent-by-weight magnesium, and 0.4 percent-by-weight silicon. Drying conditions were circulating air at 20° C. for 30 minutes.

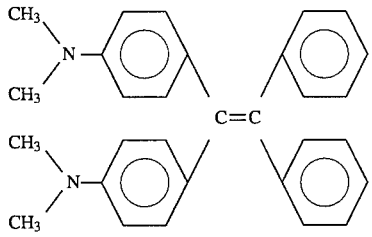

Applied over the aforesaid charge generating layer by a dipping method was an application of a fluid comprising 10 pbw styryl compound having the chemical structure shown in the equation above, 7 pbw polycarbonate (Panlite K-1300; Teijin Kasei K. K. ) dissolved in a solvent having 40 pbw 1,4-dioxane so as to form, after drying, a charge transporting layer having a thickness of 32 μm. At this time, the viscosity of the fluid was 240 cp at 20° C. Drying conditions were circulating air at 100° C. for 30 minutes.

The toner manufacturing method is described hereinafter.

First, 8 pbw carbon black (Mogul-L; Cabot, Co.), 5 pbw nigrosine stain (Bontron N-01; Orient Chemical Co.), and 3 pbw non-polar polypropylene (605P; Sanyo Kasei K. K.) were adequately mixed with 100 pbw styrene-n-butylmethacrylate resin (softening point: 132° C., glass transition temperature: 60° C.) using a ball mill. Then, this mixture was adequately mixed by three rollers heated to 140° C., and after the mixture was allowed to stand to cool, it was coarsely pulverized, followed by fine pulverization using a jet mill. The finely pulverized material was subjected to air classification, to obtain unshaped, positive-charge toner having a mean particle diameter of 7.5 μm. This toner was then subjected to a post-process of mixing 100 pbw of said toner with 0.2 pbw hydrophobic silica(R-974); Nippon Aerosil K. K.) using a Henschel mixer to impart flow characteristics.

The carrier manufacturing method is described hereinafter.

First, 2 pbw carbon black (MA#8; Mitsubishi Kasei Kogyo K. K.) and 300 pbw magnetic powder (MFP-2; TDK K. K.) were added to 100 pbw polyester resin (Tafuton NE 1110; Kao K. K.) and adequately mixed using a Henschel mixer. The derived material was further mixed by biaxial extruder, and after cooling, was coarsely pulverized. The coarsely pulverized material was finely pulverized by a jet mill pulverizer, and air classified to obtain fine polymer particles incorporating magnetic powder and having a mean particle diameter of 2 μm.

Then, 10 pbw of the aforesaid fine polymer particles incorporating magnetic powder were added to 100 pbw ferrite particles F-250HR (mean particle diameter: 50 μm; Powder-tekku K. K.) and processed in an Ang mill AAM-20F (Hosokawa Micron Co.) at 2,500 rpm for 40 minutes to obtain a carrier intermediate product having a mean particle diameter of 55 μm. The carrier intermediate product was subjected to a heating process at 400° C. using a suffusion system (Nippon Pneumatic Mfg. Co., Ltd.) to obtain a carrier having a mean particle size of 55 μm.

After the previously described toner and carrier were mixed to achieve a toner density of 7 percent-by-weight, the resulting developer was loaded in the previously mentioned developing device 3. Image formation was accomplished while maintaining toner density at 7±1 percent-by-weight by means of a toner supply unit and toner density sensor not shown in the drawings.

The method of manufacturing charging device 2 is described hereinafter. A metal shaft made of SUS 303 stainless steel having a length of 370 mm and diameter of 8 mm was used as conductive support member 11.

Film member 12 having a thickness of 50 μm was attached to the surface of the aforesaid conductive support member 11 by means of a coating of epoxy adhesive applied to edge 13. At this time, peripheral portions 14, 15, 16 of edge 13 are coated with an electrically conductive paste, so as to electrically connect conductive support member 11 and film member 12.

The aforesaid film was manufactured using a common film forming method, i.e., a casting method. During manufacture of the film, a conductive agent comprising mainly conductive carbon was added in suitable proportion, so as to regulate electrical resistivity after film formation. Film edge 17 is cut in a straight line, such that the length of said film member from peripheral portion 15 of edge 13 to film edge 17 was 24 mm.

It is readily understood that, in the first embodiment shown in FIG. 2, eight pieces of film member 12 are arranged on the peripheral surface of the substrate 11 at equidistant spacings. In the present experiment, charging device 2 utilizing 12 pieces, 36 pieces, and 64 pieces of film members 12 with suitable overlapping of edges 13 were used.

Three types of film member manufactured by the aforesaid method were used, one type of film member being formed mainly of nylon, one type of film member being formed mainly of polyimide, and one type of film member being formed mainly of polyethylene-tetrafluoroethylene copolymer. The respective film members had electrical resistivities of $1\times10^4$ Ωcm, $2\times10^5$ Ωcm, $6\times10^6$ Ωcm.

FIG. 3 shows the positional relationship between charging device 2 and photosensitive drum 1 when charging device 2 manufactured as previously described was installed in a copying machine having the essential construction shown in FIG. 1. Charging device 2 was arranged such that circumference line 21 indicated by the dashed line formed by the film edges 17 of film member 12 intersects photosensitive drum 1 as indicated by the same dashed line, and the amount X of the "bite" at the time of such intersection was set so as to be 5 mm and 10 mm.

Each type of charging devices 2 manufactured in the aforesaid manner were installed in a copying machine having the essential construction shown in FIG. 1, and image formation and image quality evaluations were conducted. Specifics of the evaluation methods are described below.

Charging device 2 made contact with photosensitive drum 1 with a "bite" of 5 mm. Rotational speed of photosensitive drum 1 was selectably set at 10 cm/sec, 25 cm/sec, and 40 cm/sec. The rotational speed of charging device 2 was selectably set so as to be one, two or three times the rotational speed of photosensitive drum 1 in the opposite direction relative to the rotation of photosensitive drum 1. As the application voltage was adjusted within a range of −1.0~1.2 kV, the surface of photosensitive drum 1 was initially charged at −600 V. At this time, the a commercial potentiometer (potentiometer model 344, Trek Co.) was used to measure the surface potential of the photosensitive drum.

when a DC voltage is used in the present invention, the voltage having the absolute value of about 800~1.500 V is desirably applied to the conductive substrate 11. When an alternating current (AC) is applied, the environmental dependence of the charge is weakened compared to a DC voltage alone applied to the substrate 11. From this perspective, it is desirable that an AC peak-to-peak voltage value is about 400~1600 V, and the frequency is desirable 200~5000 Hz; the aforesaid absolute value may be the overlaid voltage comprising a DC voltage and AC voltage.

Then, using a 6% chart as an original document, 30,000 copies were made to produce a state of long-term use of charging device 2.

Finally, a half document having a density of 0.4 was placed on the document platen and exposed via exposure light from position L in FIG. 1, and the produced latent image was developed by developing device 3 to produce a toner image which was transferred onto a transfer sheet having a density of 0.03, to obtain sample images for use in streak-like image noise evaluations. At this time, the amount of exposure light was suitably adjusted, to achieve a maximum image density value of 1.0 by the image density evaluation described below.

The obtained image samples were measured for image density using a commercial image densitometer (Sakura Microdensitometer model PDM-5, type BR; Konica), under these conditions: 50-fold magnification; scanning speed: 100 μm/sec; measured area: 50 $\mu m^2$; for a length of 10 cm in the scanning direction relative to the lengthwise direction of the photosensitive member. At this time, the image density was derived from the maximum measured image density (1.0) and minimum image density, and was used for function evaluation.

Image samples within an image density difference of 0.2 were designated images for which streak-like image density irregularities due to charging were absent, and were given rank A in the evaluation. Although slight irregularity was visible, image samples having an image density difference in excess of 0.2 but not more than 0.35 were designated images which posed no practical problem with respect to streak-like image density irregularities due to charging, and were given rank B. Image samples having an image density difference in excess of 0.35 were designated inappropriate for practical use since streak-like image density irregularities due to charging could be visually recognized, and were given rank C.

Reference experiments were conducted with charging device 2 in a stationary state, i.e., charging by a single film member in the manner previously described. Definite differences were observed relative to the performance of the invention under the above described conditions.

Figure 7:
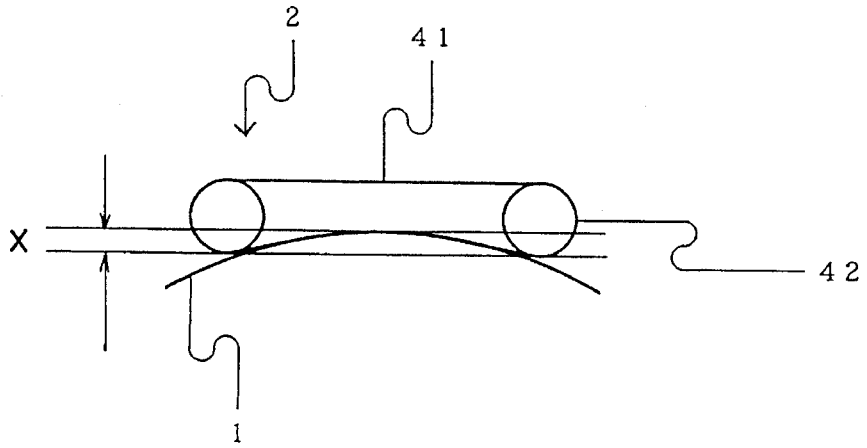
FIG. 7 shows a charging device used as a reference example relative to the charging device of the present invention.

As shown in FIG. 7, a belt-shaped nylon film 41 having a circumferential length of 20 cm was used directly as a reference charging device 2 capable of being rotated by drive roller 42 having a major diameter of 10 mm. The previously described tests were performed as photosensitive drum 1 was rotatably driven, and differences in performance were observed compared to those of the device present invention.

Table 1 shows evaluation results when nylon film was used with the various types of charging devices 2 having a "bite" X of 5 mm.

The reference examples shown in Table 1 of a fixed type (refer to FIG. 3) and belt type (refer to FIG. 7) film member invariably had a "bite" X of 5 mm.

TABLE 1

| | Resistance | Drum speed | Charger speed (fold increase) | Embodiments No. of films | | | Reference examples | |
|---|---|---|---|---|---|---|---|---|
| | (Ω/cm) | (cm/s) | | 12 | 36 | 64 | Fixed | Belt |
| Nylon Bite: 5 mm | $1 \times 10^4$ | 10 | 1 | B | A | A | C | C |
| | | | 3 | A | A | A | | |
| | | | 5 | A | A | A | | |
| | | 25 | 1 | B | A | A | C | C |
| | | | 3 | A | A | A | | |
| | | | 5 | A | A | A | | |
| | | 40 | 1 | B | A | A | C | C |
| | | | 3 | B | A | A | | |
| | | | 5 | A | A | A | | |
| Nylon Bite: 5 mm | $2 \times 10^5$ | 10 | 1 | B | A | A | C | C |
| | | | 3 | A | A | A | | |
| | | | 5 | A | A | A | | |
| | | 25 | 1 | B | A | A | C | C |
| | | | 3 | A | A | A | | |
| | | | 5 | A | A | A | | |
| | | 40 | 1 | B | A | A | C | C |
| | | | 3 | A | A | A | | |
| | | | 5 | A | A | A | | |
| Nylon Bite: 5 mm | $5 \times 10^6$ | 10 | 1 | B | A | A | C | C |
| | | | 3 | B | A | A | | |
| | | | 5 | A | A | A | | |
| | | 25 | 1 | B | A | A | C | C |
| | | | 3 | B | A | A | | |
| | | | 5 | A | A | A | | |
| | | 40 | 1 | B | B | A | C | C |
| | | | 3 | B | A | A | | |
| | | | 5 | A | A | A | | |

Identical results to those described in Table 1 were obtained when the "bite" of the nylon film was set at 10 mm.

The various types of charging device 2 using polyamide film were tested with the "bite" of said film set at 5 mm and 10 mm, and identical results were obtained.

The various types of charging device 2 using polyethylene-tetrafluoroethylene copolymer film were tested with the film "bite" set at 5 mm and 10 mm and identical results were obtained.

It can be understood from the previously described results that the charging device using a plurality of films rotatably arranged of the present invention provides excellent images with stable performance without streak-like image noise generation, even in image forming apparatus having the processing speed in the high-speed range requiring a high degree of durability, unlike conventional stationary film charging devices and belt-like charging devices.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A charging member for charging a surface of a charge-receiving member, comprising:

a rotatable support member; and a plurality of flexible films; one end of each of said films being attached to said support member, and a free end of each of the films being in contact with the surface of the charge-receiving member for charging the surface of the charge-receiving member.

2. A charging member claimed in claim 1 wherein said support member is formed of conductive materials.

3. A charging member as claimed in claim 2 wherein each of the films is fixed to the support member by an adhesive.

4. A charging member as claimed in claim 3 wherein an electrically conductive paste is applied to peripheral portions of an adhesive portion of each of the films and the support member.

5. A charging member as claimed in claim 4 wherein a voltage is applied to the support member.

6. A charging member as claimed in claim 2 wherein the conductive materials include metallic materials or resin materials and fiber materials which have been subjected to treatment so as to be rendered electrically conductive.

7. A charging member as claimed in claim 1 wherein the films are formed of plastic film materials in which are dispersed powder-like or fiber-like conductive carbon, metals, metallic oxides and conductive polymers.

8. A charging member as claimed in claim 1 wherein electrical resistivity of the films is $10^3$ Ωcm or greater and not more than $10^8$ Ωcm.

9. A charging member as claimed in claim 1 wherein a thickness of the films is about 5–500 μm.

10. A charging member as claimed in claim 1 wherein the support member is rod-shaped.

11. A charging member as claimed in claim 1 wherein the support member is a belt-like member.

12. A charging member as claimed in claim 1 further comprising:

a conductive removing member provided adjacently to the film out of contact with the charge-receiving member and to which a voltage is applied for removing debris adhered on the surface of the films.

13. An image forming apparatus comprising:

a rotatable photoreceptor; and a charging device which charges the surface of said photoreceptor and includes a rotatable member an outer peripheral surface of which a plurality of blades are provided so as to be in contact with the surface of the photoreceptor.

14. An image forming apparatus as claimed in claim 13 wherein the rotatable member rotates in a direction opposed to a rotational direction of the photoreceptor.

15. An image forming apparatus as claimed in claim 13 wherein a rotational speed Vd of the photoreceptor and a rotational speed Vc of the rotatable member satisfy the following relationship:

$$Vc \geqq Vd$$

16. An image forming apparatus as claimed in claim 13 wherein the rotatable member and the blades are conductive.

17. An image forming apparatus as claimed in claim 16 wherein each of the blades is fixed to the rotatable member by an adhesive.

18. An image forming apparatus as claimed in claim 17 wherein an electrically conductive paste is applied to peripheral portions of an adhesive portion of each the blades and the rotatable member.

19. An image forming apparatus as claimed in claim 18 wherein a voltage is applied to the rotatable member.

20. An image forming apparatus as claimed in claim 13 further comprising:

a conductive removing member provided adjacently to the blade out of contact with the photoreceptor and to which a voltage is applied for removing debris adhered on the surface of the blades.

21. A method for charging the surface of a charge-receiving member, said method comprising:

providing a conductive rotatable support member so as to confront the charge-receiving member;

providing a plurality of conductive films on said support member;

applying a predetermined voltage to the support member; and scraping the surface of the charge-receiving member with the films by rotating the support member thereby charging the surface of the charge-receiving member.

* * * * *